US009774963B1

(12) United States Patent
Han

(10) Patent No.: US 9,774,963 B1
(45) Date of Patent: Sep. 26, 2017

(54) EAR-WING

(71) Applicant: Seung Kwan Han, Anyang-si (KR)

(72) Inventor: Seung Kwan Han, Anyang-si (KR)

( * ) Notice: Subject to any disclaimer, the term of this patent is extended or adjusted under 35 U.S.C. 154(b) by 0 days.

(21) Appl. No.: 15/086,993

(22) Filed: Mar. 31, 2016

(30) Foreign Application Priority Data

Mar. 7, 2016 (KR) ..... 10-2016-0026843

(51) Int. Cl.
*H04R 25/00* (2006.01)
*H04R 1/10* (2006.01)

(52) U.S. Cl.
CPC ..... *H04R 25/652* (2013.01); *H04R 1/105* (2013.01)

(58) Field of Classification Search
CPC .... H04R 1/1016; H04R 1/105; H04R 1/1058; H04R 1/1066; H04R 2201/107; H04R 1/1033; H04R 1/1041; H04R 1/1083; H04R 2201/109; H04R 2420/07; H04R 2420/09; H04R 25/656; H04R 1/02; H04R 1/028
USPC ..... 381/380
See application file for complete search history.

(56) References Cited

U.S. PATENT DOCUMENTS 9,036,852 B2 5/2015 Silvestri et al. ..... 381/322
2011/0255729 A1* 10/2011 Tan ..... H04R 1/105 381/380
2012/0039500 A1* 2/2012 Silvestri ..... H04R 1/1016 381/380
2014/0119589 A1* 5/2014 Wyzisk ..... H04R 1/105 381/380
2014/0286515 A1* 9/2014 Bone ..... H04R 1/1016 381/328
2016/0045373 A1* 2/2016 Williams ..... A61F 11/12 181/135
2016/0073186 A1* 3/2016 Searl ..... H04R 1/1016 381/380

FOREIGN PATENT DOCUMENTS

KR 20-0371712 Y1 1/2005

OTHER PUBLICATIONS

Korean Office Action dated Jan. 19, 2017, issued to the corresponding Korean Application No. 10-2016-0026843.

* cited by examiner

*Primary Examiner* — Md S Elahee
*Assistant Examiner* — Julie X Dang
(74) *Attorney, Agent, or Firm* — Stein IP, LLC

(57) ABSTRACT

The present invention relates to an ear wing including: a coupling portion coupled to a sound output device; a deformable fixing portion deformed with a curvature to correspond to the shape of the antihelix in such a manner as to be located inside the antihelix and for fixing the position of the coupling portion to an external ear; and a variable portion for connecting the coupling portion and the deformable fixing portion in such a manner as to support the deformable fixing portion thereagainst and having at least one or more variable parts changed in shape according to the deformation of the deformable fixing portion. In addition, according to the present invention, the pressure applied to the surrounding portions of the antitragus and the tragus can be minimized through the structure of connecting the coupling portion and the variable portion, so that wearing comfort becomes excellent, and even if the user wears the ear wing for long hours, he or she does not feel uncomfortable, thus optimizing the conveniences in use.

6 Claims, 3 Drawing Sheets

EAR-WING

BACKGROUND OF THE INVENTION

Field of the Invention

The present invention relates to an ear wing used for an earphone or hearing aid.

Background of the Related Art

In general, an earphone is a sound transmitting device widely used for communication, learning or listening to music, and the like, and there are a variety of types of earphones such as open type earphones, carnal type earphones, ear-hanging type earphones, and so on.

As various portable multimedia devices have been prevailed, speakers embedded in the multimedia devices (for example, smartphone) are not used so as to prevent damages caused by the usage thereof from being given to other persons. Instead of the speakers, an earphone is generally used in such a manner as to be connected to an earphone jack mounted on the multimedia device. Therefore, the demand on the earphone is expected to be gradually increased in the future.

However, eartips of recently launched earphones, which are worn on the ears of users, have almost uniform shapes, and when considering different ear structures and features according to users, accordingly, it is difficult that the earphones are fixed to the ears of the users.

So as to solve the above-mentioned problems, accordingly, there is proposed U.S. Pat. No. 9,036,852 (hereinafter, referred to as 'conventional practice'). According to the conventional practice, an earpiece positioning and fixing structure is suggested.

In more detail, the earpiece positioning and fixing structure in the conventional practice includes an outer leg and an inner leg each having one end coupled to different portions (one side and the other side) of an eartip and the other end coupled to each other, wherein the outer leg is located along the inner side of the antihelix and the inner leg comes into contact with the base of an external ear.

So as to fix the earpiece to the external ear, according to the conventional practice, the outer leg extended from one side of the eartip comes into contact with the antitragus formed on the end of the antihelix, and the inner leg extended from the other side of the eartip comes into contact with the tragus. If the earpiece is worn for long hours, accordingly, the portions around the antigragus and the tragus may be compressed against the outer leg and the inner leg, thus causing wearing comfort to be bad and making the user feel uncomfortable.

SUMMARY OF THE INVENTION

Accordingly, the present invention has been made in view of the above-mentioned problems occurring in the prior art, and it is an object of the present invention to provide an ear wing that is capable of allowing the position of a sound output device to be contactedly fixed stably to an external ear and further minimizing the pressure applied to the antitragus and the tragus.

To accomplish the above-mentioned object, according to the present invention, there is provided an ear wing including: a coupling portion coupled to a sound output device; a deformable fixing portion deformed with a curvature to correspond to the shape of the antihelix in such a manner as to be located inside the antihelix and for fixing the position of the coupling portion to an external ear; and a variable portion for connecting the coupling portion and the deformable fixing portion in such a manner as to support the deformable fixing portion thereagainst and having at least one or more variable parts changed in shape according to the deformation of the deformable fixing portion.

According to the present invention, desirably, the coupling portion is rotatably coupled to the sound output device.

According to the present invention, desirably, the deformable fixing portion includes: a fitting portion extended from one side of the deformable fixing portion in such a manner as to be fitted to a space between the antihelix and the crus of helix; and a deformable portion extended with a given curvature from the other side of the deformable fixing portion toward the antitragus, located inside the antihelix, and deformed in accordance with the shape of the antihelix.

According to the present invention, desirably, the variable portion includes a first variable part for connecting one side of the coupling portion and the surrounding portion of the fitting portion formed on one side of the deformable fixing portion to each other and changed in shape through the deformation of the deformable fixing portion.

According to the present invention, desirably, the first variable part is curved with a curvature in accordance with the protruding degree of the crus of helix.

According to the present invention, desirably, the variable portion further includes: a second variable part for connecting one side of the coupling portion and the other side of the deformable fixing portion to each other and changed in shape through the deformation of the deformable fixing portion, wherein a variable space portion is formed between the first variable part and the second variable part in such a manner as to be changed in shape by means of the first variable part and the second variable part.

According to the present invention, desirably, the deformable fixing portion and the variable portion are made of an elastic material.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Hereinafter, if it is determined that the detailed explanation on the well known technology related to the present invention makes the scope of the present invention not clear, the explanation will be avoided for the brevity of the description. Further, terms, such as the first and the second may be used to describe various elements, but the elements should not be restricted by the terms. The terms are used to only distinguish one element from the other element.

Further, the terms used in the specification and claims are not limitedly interpreted only as the meanings defined in dictionaries, and they should be interpreted as having the meanings and concepts corresponding to the technical ideas of the present invention, on the basis of the principle where the concepts of the terms can be appropriately defined by the inventor so that the invention is explained in the best way.

Accordingly, the configurations in the embodiments and drawings of the specification are just examples according to preferred embodiments of the invention, and since they do not express fully the technological scope of the present invention, it should be understood that various equivalents and modifications replacing the configurations of the invention may exist at the time when the invention is filed.

The preferred embodiments of the present invention will be in more detail described, but for the brevity of the description, an explanation on well known technological parts will be avoided or briefly given.

1. Explanation on Structure of External Ear

Figure 1:
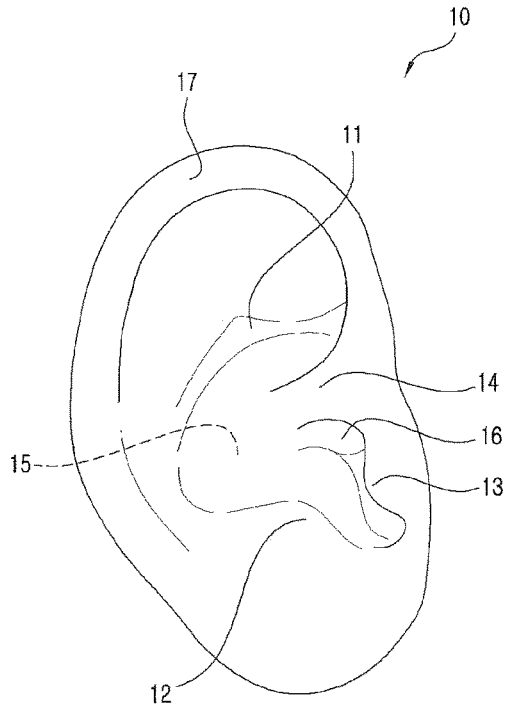
FIG. 1 is a schematic view showing a structure of an external ear.

FIG. 1 is a schematic view showing a structure of an external ear (10).

Referring to FIG. 1, an external ear 10 includes the antihelix 11, the antitragus 12, the tragus 13, the crus of helix 14, the concha 15, the acoustic meatus 16, and the helix 17.

As shown in FIG. 1, the helix 17 is the prominent rim of the external ear 10, the antihelix 11 is the prominent portion on the inside of the helix 17 in parallel with the helix 17, and the antitragus 12 is a small triangular protrusion located at the end portion of the antihelix 11.

Further, the tragus 13 is a triangular protrusion formed in front of the acoustic meatus 16, the concha 15 is a deep depression located above the antitragus 12, and the crus of helix 14 is the front portion of the helix 17 which starts at the bottom portion of the concha 15.

2. Explanations on Components of Ear Wing and Worn State of Ear Wing

Figure 2:
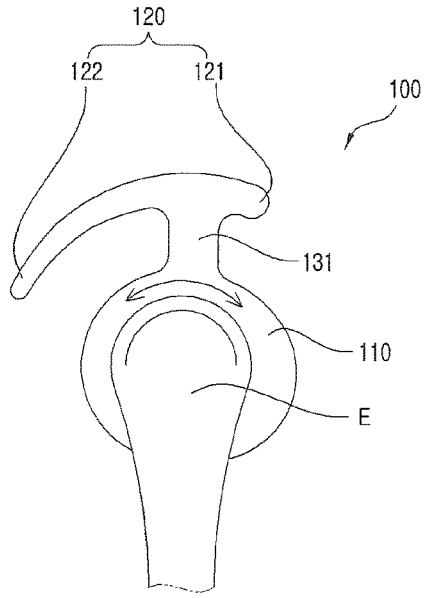
FIG. 2 is a view showing components of an ear wing according to a first embodiment of the present invention.
Figure 3:
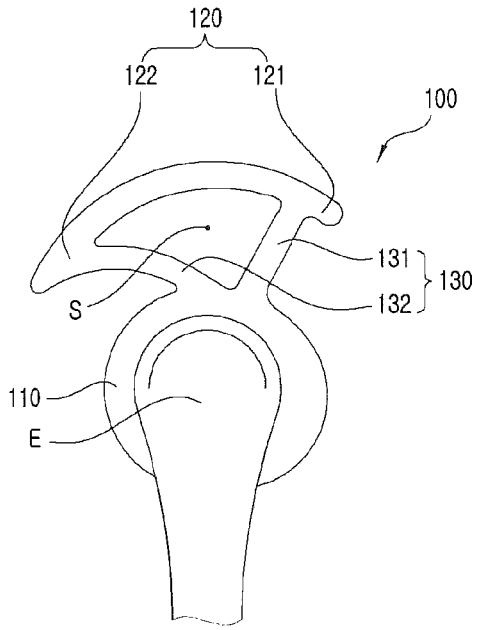
FIG. 3 is a view showing components of an ear wing according to a second embodiment of the present invention.
Figure 4:
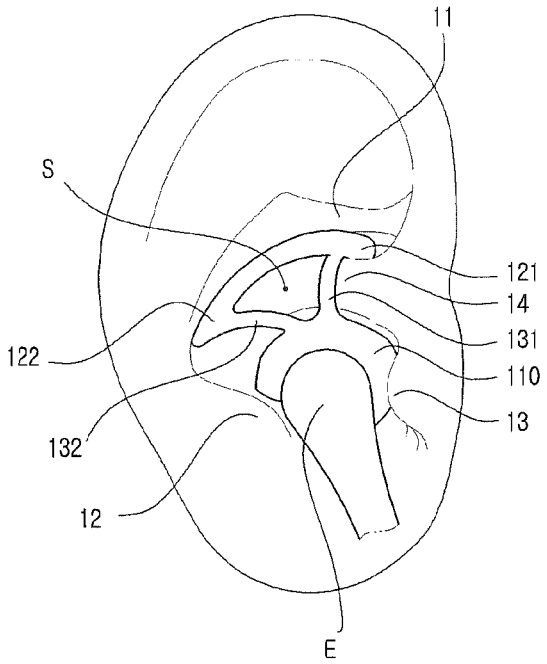
FIG. 4 is a view showing a state wherein the ear wing according to the second embodiment of the present invention is worn on a user's ear.
Figure 5:
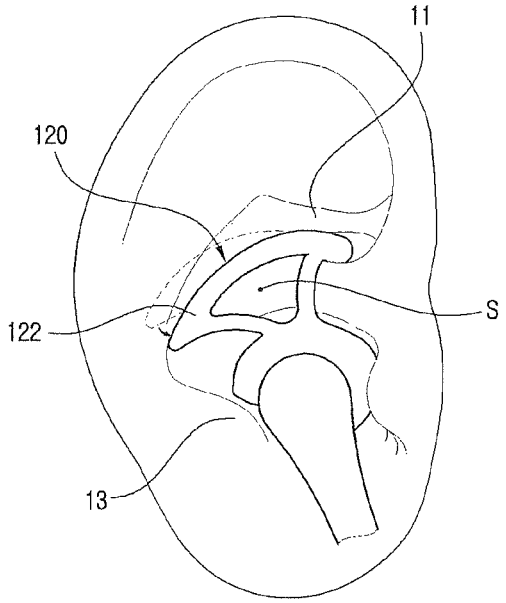
FIG. 5 is a view showing a state wherein the ear wing according to the second embodiment of the present invention is worn on the user's ear through the deformation of a deformable portion.
Figure 6:
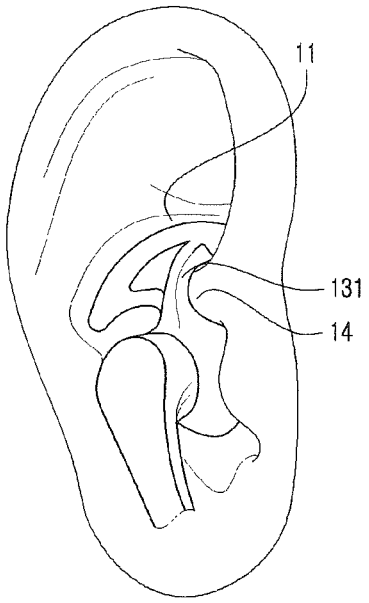
FIG. 6 is a view showing a state wherein a first variable portion of the ear wing according to the second embodiment of the present invention is worn on the user's ear.

FIG. 2 is a view showing components of an ear wing according to a first embodiment of the present invention, FIG. 3 is a view showing components of an ear wing according to a second embodiment of the present invention, FIG. 4 is a view showing a state wherein the ear wing according to the second embodiment of the present invention is worn on a user's ear, FIG. 5 is a view showing a state wherein the ear wing according to the second embodiment of the present invention is worn on the user's ear through the deformation of a deformable portion, and FIG. 6 is a view showing a state wherein a first variable part of the ear wing according to the second embodiment of the present invention is worn on the user's ear.

Referring to FIGS. 2 to 6, an ear wing 100 according to the present invention largely includes a coupling portion 110, a deformable fixing portion 120, and a variable portion 130.

As shown in FIG. 2, the coupling portion 110 is coupled to a sound output device E, and accordingly, the coupling portion 110 has a space adapted to accommodate a portion of the sound output device E thereinto. Further, the coupling portion 110 may be coupled rotatably to the sound output device E.

As shown in FIG. 2, the deformable fixing portion 120 is located with a given curvature inside the antihelix 11 in such a manner as to allow the coupling portion 110 to be located fixedly to the external ear 10.

In this case, desirably, the deformable fixing portion 120 is not brought into contact with the region around the antitragus 12 located on the end portion of the antihelix 11. The reason is that the pressure against the region around the antigragus 12 can be minimized when the sound output device E is fixed through the deformable fixing portion 120.

Further, the deformable fixing portion 120 is changed in shape in accordance with the shape of the antihelix 11 and is desirably made of an elastic material or a soft material (for example, silicone) so as to improve the wearing comfort thereof.

As shown in FIG. 4, the deformable fixing portion 120 is located inside the antihelix 11, so that as a portion of the coupling portion 110 is inserted into the acoustic meatus 16, the coupling portion 110 can be stably fixed to the external ear 10. To this end, as shown in FIG. 2, the deformable fixing portion 120 includes a fitting portion 121 and a deformable portion 122.

The fitting portion 121 is extended from one side of the deformable fixing portion 120 in such a manner as to be fitted to the space between the antihelix 11 and the crus of helix 14. The formation of the fitting portion 121 improves the fixing force of the coupling portion 110 to the external ear 10 and the fixing force of the sound output device E coupled to the coupling portion 110.

The deformable portion 122 is extended from the other side of the deformable fixing portion 120 toward the antitragus 12 in such a manner as to be located inside the antihelix 11, and further, the deformable portion 122 is deformed in accordance with the shape of the antihelix 11. That is, the deformable portion 122 is located with a given curvature between the antihelix 11 and the concha 15 in such a manner as to be deformed appropriately with respect to the shape of the antihelix 11.

The variable portion 130 connects the coupling portion 110 and the deformable fixing portion 120 to each other in such a manner as to support the deformable fixing portion 120 thereagainst, so that the coupling portion 110, the deformable fixing portion 120, and the variable portion 130 are formed integrally with each other.

In this case, the variable portion 130 has at least one or more variable parts changed in shape according to the deformation of the deformable fixing portion 120, and in the same manner as the deformable fixing portion 120, the variable portion 130 is desirably made of an elastic material or a soft material so as to improve the wearing comfort thereof.

The variable portion 130 is extended from one side of the coupling portion 110 and connected to the deformable fixing portion 120, so that a portion of the coupling portion 110 is not brought into contact with the region around the antihelix 11, thus minimizing the pressure applied to the region around the antihelix 11 and the tragus 13.

Further, as shown in FIGS. 2 and 3, the variable portion 130 includes a first variable part 131.

The first variable part 131 connects one side of the coupling portion 110 and the surrounding portion of the fitting portion 121 formed on one side of the deformable fixing portion 120 to each other, and further, the first variable part 131 is changed in shape through the deformation of the deformable fixing portion 120.

As shown in FIG. 6, desirably, the first variable part 131 can be curved with a curvature in accordance with the protruding degree of the crus of helix 14. Accordingly, the first variable part 131 is provided appropriately in accordance with the shape of the crus of helix 14 in such a manner as to avoid the interference with the crus of helix 14, thus more stably fixing the deformable fixing portion 120 to the inside of the antihelix 11. That is, the first variable part 131 is curved outwardly from the external ear 10 with a curvature in correspondence to the outwardly protruding shape of the crus of helix 14 from the external ear 10.

According to the second embodiment of the present invention, as shown in FIG. 3, the variable portion 130 further includes a second variable part 132. The second variable part 132 connects one side of the coupling portion 110 and the other side of the deformable fixing portion 120 to each other, and in the same manner as the above-mentioned first variable part 131, the second variable part 132 is changed in shape through the deformation of the deformable fixing portion 120.

Like this, the ear wing according to the present invention is configured wherein the coupling portion 110 is rotatably coupled to the sound output device E in such a manner as to be adequate to the structure or features of the external ear 10 of a user, and accordingly, the deformable fixing portion 120 is deformed, so that through the deformation of the deformable fixing portion 120, the variable portion 130 is changed in shape to allow the coupling portion 110 and the sound output device E to be more stably located fixedly to the external ear 10.

Accordingly, the coupling portion 110 and the sound output device E are stably fixed to the external ear 10 by means of the deformable fixing portion 120 and the variable portion 130, so that even during the user's outside activities, the coupling portion 110 and the sound output device E are not easily escaped from the external ear 10 of the user.

Moreover, the variable portion 130 has a variable space S formed between the first variable part 131 and the second variable part 132 in such a manner as to be changed in shape by means of the first variable part 131 and the second variable part 132, and accordingly, the shape of the variable portion 130 is changed in shape to correspond to the width of the concha 15. Through the formation of the variable space S, further, the first variable part 131 and the second variable part 132 may be changed in shape by means of the deformation of the deformable fixing portion 120 or the structure of the external ear 10 (for example, the structures of the antihelix 11 and the crus of helix 14 and the like).

That is, the shapes or structures of the antihelix 11 are different according to the users who wear the ear wing 100 according to the present invention, and accordingly, as shown in FIG. 5, the deformable portion 122 is deformed correspondingly to the shape of the antihelix 11 and located inside the antihelix 11 in the state wherein the fitting portion 121 is fitted to the space between the antihelix 11 and the crus of helix 14. As a result, the first variable part 131, the second variable part 132, and the variable space S are changed in shape.

Further, the variable portion 130 includes other variable parts like the first variable part 131 and the second variable part 132 as mentioned above, and accordingly, the number of variable spaces S formed between the variable parts may be increased in accordance with the number of variable parts.

As mentioned above, the ear wing 100 according to the present invention is configured wherein the coupling portion 110 and the sound output device E are stably contactedly fixed to the external ear 10 by means of the deformable fixing portion 120 and the variable portion 130, and further, the pressure applied to the surrounding portions of the antitragus 12 and the tragus 13 can be minimized through the structure of connecting the coupling portion 110 and the variable portion 130, so that wearing comfort becomes excellent and even if the user wears the ear wing 100 for long hours, he or she does not feel uncomfortable, thus optimizing the conveniences in use.

Further, the sound output device E fixed to the external ear 10 by means of the ear wing 100 according to the present invention may be an earphone or hearing aid, so that the ear wing 100 according to the present invention may be applied to a variety of sound output devices E.

As described above, the ear wing according to the present invention has the following advantages.

Firstly, the pressure applied to the surrounding portions of the antitragus and the tragus can be minimized through the structure of connecting the coupling portion and the variable portion, so that wearing comfort becomes excellent, and even if the user wears the ear wing for long hours, he or she does not feel uncomfortable, thus optimizing the conveniences in use.

Secondly, the coupling portion is rotatably coupled to the sound output device in such a manner as to be adequate to the structure or features of the external ear of the user, and accordingly, the deformable fixing portion is deformed, so that through the deformation of the deformable fixing portion, the variable portion is changed in shape to allow the coupling portion and the sound output device to be more stably located fixedly to the external ear.

Lastly, the coupling portion and the sound output device are stably fixed to the external ear by means of the deformable fixing portion and the variable portion, so that even during the user's outside activities, the coupling portion and the sound output device are not easily escaped from the external ear of the user.

What is claimed is:

1. An ear wing comprising:

a coupling portion coupled to a sound output device;

a deformable fixing portion deformed with a first curvature to correspond to the shape of an antihelix of an external ear in such a manner as to be located inside the antihelix and for fixing the position of the coupling portion to the external ear; and a variable portion for connecting the coupling portion and the deformable fixing portion to each other in such a manner as to support the deformable fixing portion thereagainst and having at least one variable part changed in shape according to the deformation of the deformable fixing portion, the variable portion including a first variable part formed in a location corresponding to a crus of helix of the external ear, wherein the deformable fixing portion comprises:

a fitting portion extended in one direction from a joint of the deformable fixing portion and the first variable part in such a manner as to be fitted to the space between the antihelix and the crus of helix; and a deformable portion extended longer than the fitting portion in another direction, with a second curvature, from the joint of the deformable fixing portion and the first variable part toward an antitragus of the external ear, located inside the antihelix, the deformable portion being configured to be deformed in accordance with the shape of the antihelix and located inside the antihelix.

2. The ear wing according to claim 1, wherein the coupling portion is rotatably coupled to the sound output device.

3. The ear wing according to claim 1, wherein the variable portion comprises the first variable part for connecting one side of the coupling portion and a surrounding portion of the fitting portion formed on one side of the deformable fixing portion to each other and changed in shape through the deformation of the deformable fixing portion.

4. The ear wing according to claim 3 wherein the first variable part is curved with a third curvature in accordance with the protruding degree of the crus of helix.

5. The ear wing according to claim 3, wherein the variable portion further comprises:

a second variable part for connecting one side of the coupling portion and the other side of the deformable fixing portion to each other and changed in shape through the deformation of the deformable fixing portion, wherein a variable space portion is formed between the first variable part and the second variable part in such a manner as to be changed in shape by means of the first variable part and the second variable part.

6. The ear wing according to claim 1, wherein the deformable fixing portion and the variable portion are made of an elastic material.

* * * * *